United States Patent [19]

Dickerson et al.

[11] Patent Number: 5,067,428

[45] Date of Patent: Nov. 26, 1991

[54] PORTABLE BOAT DOCK

[76] Inventors: Mack F. Dickerson, 948 W. Simmons, Tucson, Ariz. 85705; Curt J. Hendricks, 6990 N. Blue Sky Ter., Tucson, Ariz. 85741; Gregory A. Hendricks, 5303 E. Cortland Blvd., Apt. J-8, Flagstaff, Ariz. 86004

[21] Appl. No.: 585,953

[22] Filed: Sep. 21, 1990

[51] Int. Cl.[5] ..... B63B 21/00

[52] U.S. Cl. ..... 114/230; 405/1

[58] Field of Search ..... 114/230, 263, 44; 405/1, 3, 7, 218–221

[56] References Cited

U.S. PATENT DOCUMENTS

| | | | |
|---|---|---|---|
| 2,774,322 | 12/1956 | Harris | 114/46 |
| 2,930,339 | 3/1960 | Trnka | 114/230 |
| 3,074,241 | 1/1963 | Cahill et al. | 405/221 |
| 3,587,874 | 6/1971 | Graf | 405/1 |
| 4,776,726 | 10/1988 | Viles | 405/221 |

*Primary Examiner*—Jesûs D. Sotelo

*Attorney, Agent, or Firm*—J. Michael McClanahan

[57] ABSTRACT

A portable boat dock consisting of a modified "H" shaped platform adapted to reside substantially underwater, the platform having attached to it two upwardly protruding arms with cradle members attached to engage opposite sides of a boat to be docked. The platform lower portion consists of a pair of spaced apart angled legs adapted to penetrate a distance into the lake bottom to secure the platform. Holding the platform upright is an attached elongated tongue, the tongue also operably attached to a front holding stake driven into the ground at the shoreline of the lake, the stake also containing a ring to receive a rope from the bow of the boat to secure the boat. The invention may be easily placed into the lake and removed by utilizing connecting pins which permit separation of the platform from the tongue and from the front stake. Various lake depths are accounted for by telescoping legs and various sized boats are accommodated by spreading or narrowing the angle between the upright cradle members.

14 Claims, 1 Drawing Sheet

PORTABLE BOAT DOCK

BACKGROUND OF THE INVENTION

1. Field of the Invention

The field of the invention is boat docks for pleasure boats and especially those boat docks which are portable, i.e., may be easily placed into and removed from the water as desired or needed.

2. Description of the Related Art

As any experienced or inexperienced boatman will tell you, it is much more convenient and easier to dock one's boat to a pier or other dock facility than it is to beach the boat at the shore of a lake or other body of water. At a docking facility, means are usually provided to tie the boat up and restraints placed on one or both sides to keep it from floating away or from being struck by other boats. On a pier type dock, the boat may be brought up to the pier and then both ends of the boat tied to the pier with a cushioning material such as a rubber tire between the two. Other docks may have individual slips for boats and the boat need only to be tied at its bow end to a holding facility with a rope or the like, the slip providing constructed walkways on each side of the boat.

However, problems immediately arise if one is attempting to dock a boat at a lake or other body of water not having or away from an established dock facility. In that case, generally the boat is beached if possible, and if not possible, run up to the shoreline as close as can be accomplished and then the boat tied by means of a rope to a tree or some other standard near the edge of the lake. This manner of docking leaves one's boat subject to drift and possible damage due to the drift or, damages due to other causes when the boat is not made secure other than the tieing the bow.

Now there have been dock assemblies available to sportsmen for docking away from a recognized docking facility. For example, Trnka in U.S. Pat. No. 2,930,339, discloses a small boat mooring device wherein a small boat equipped with eyelets on both sides of the stern is moved or backed into position next to the dock. At that time the invention's "U" shaped arms operably attach to the dock connects with the spaced apart eyelets on the stern of the small boat. The central portion of the "U" shaped mooring device is firmly held to the dock. In addition, steps are provided on the arms for a person stepping from the dock into the stern of the boat.

In another dock facility, Viles in U.S. Pat. No. 4,776,726 discloses a boat dock construction of an easily assembled pier type. Lastly, Harris in U.S. Pat No. 2,774,322, discloses a portable floating dry dock for a sea plane consisting of three sections connected together by struts, one section situated at the front of the plane and partially submerged sections under each wing of the plane.

While the above devices certainly accomplish the purpose for which they were devised, yet the inventors are unaware of any portable docking facility which may be easily picked up and carried by the sportsman in his vehicle or in the boat itself which is to be docked and which may be readily emplaced along the shoreline of a lake or other body of water to provide protection for the boat from drift or the consequences of drifting.

It is readily apparent then that a portable boat dock which may be easily portable by the boat itself to be docked or by vehicle to a desired location would be quite advantageous to a sportsman or hunter or fisherman who plans to use his watercraft away from established dock facilities.

It is also obvious that there is need for boat dock apparatus which may accommodate boats of various sizes and which are adaptable to various depths of water proximate the shoreline.

SUMMARY OF THE INVENTION

The embodiment of the invention described consists of a portable boat dock having two primary constituents or parts. The first part consists of a modified "H" shaped platform which actually receives the sides of the boat hull, and the second part of a telescoping tongue attached to the modified "H" platform assuring that the platform continually resides upright and to a shoreline stake securing the tongue to the ground at or near the shoreline. The stake also has a ring attached to it adapted to receive a rope connected with the bow of the boat.

More particularly, the modified "H" shaped platform comprises of a pair of telescoping legs angled to each other and to the central horizontal portion of the "H", the telescoping legs adapted to reside upon the bottom of the lake, or perhaps a few inches or foot or so into the bottom of the lake, depending upon the bottom's composition. The top portion of the modified "H" platform consists of a pair of upwardly protruding, pivotally mounted, spaced apart arms which have, in addition, attached extension arms. Then, to the extension arms are attached redwood strips of lumber, the lumber preferably covered with rug-type material which makes contact with the outsides of the boat hull. For adjustment for different sized or width boats, the particular angle between the out-stretched arms may be varied and then locked in position with a structural member connecting between each arm and the center portion of the modified "H" platform. By such pivotal means, the particular angle formed by each upwardly protruding arm is fixed. Lastly, the extension arms operably attached to each arm is allowed a small amount of rotational freedom so that the redwood pieces of lumber attached to these extension arms pivot a small amount to accommodate the sides of the boat so that the pieces of lumber may flatly engage each side.

At the center of the modified "H" platform is attached the telescoping tongue which reaches from the modified "H" platform to a ground stake hammered into the ground at or near the lake shore. The stake runs through the distal end on the tongue to secure it. It is anticipated that this distal end of the tongue connecting the stake will be at or near the ground level, just having emerged from the water.

The portable boat dock is placed into the water so that a substantial portion of the platform is under water with only part of the two upwardly protruding angled arms (with their connected redwood boards) rising above the water. The tongue initially starts out where it is connected with the "H" platform under water and rises to a point where it connects with the ground stake. A ring attached to the ground stake receives a rope tied to the boat when the boat is docked.

The device is easily movable and for ease of storing, the telescoping legs may be drawn in to a minimum length and the normally upwardly protruding arms laid flat as to form a straight angle so that the device occupies minimal space. The tongue is disconnected from the platform and from the ground stake and may be reduced to its minimum length by drawing the inner portion into the outer portion. The whole invention may be picked up and then carried by the sportsman in the boat or motor vehicle to the location next desired or may be stored, in which case, it requires minimum space.

Accordingly, it is an object of the subject invention to provide a portable boat dock for small pleasure boats which may be easily carried, assembled, and emplaced at or near the shoreline or other body of water.

It is another object of the subject invention to provide a portable boat dock which will accommodate various sized boats, both in length and in the width of the boat hull.

It is still another object of the subject invention to provide a portable boat dock which may be easily collapsed to occupy minimum storage space.

Other objects of the invention will in part be obvious and will in part appear hereinafter. The invention accordingly comprises the apparatus and method comprising construction, combination of elements, and arrangement of parts which are exemplified in the following detailed disclosure and the scope of the application which will be indicated in the claims.

BRIEF DESCRIPTION OF THE DRAWINGS

For further understanding of the nature and objects of the present invention, reference should be had to the following detailed description taken in connection with the accompanying drawings wherein.

In various views, like index numbers refer to like elements.

DETAILED DESCRIPTION OF THE PREFERRED EMBODIMENT

Figure 1:
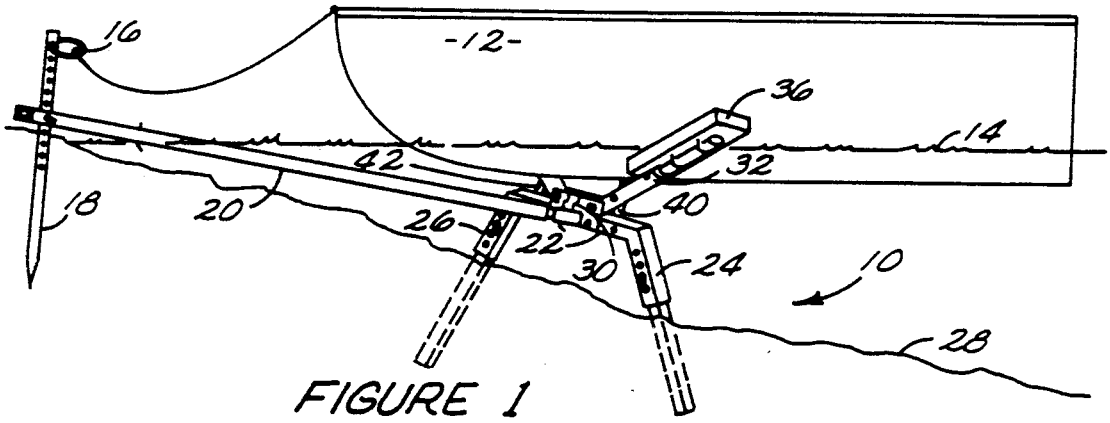
FIG. 1 is a perspective view of the subject inventive portable boat dock docking a boat.

Referring now to FIG. 1, a perspective view of the subject inventive portable boat dock is shown in use docking boat 12 at or near the shoreline of water 14 of the lake or other body of water. In this view, the details of the invention are shown as if the water were so clear the parts were visible underwater. In FIG. 1, boat 12 is secured at its forward or bow end by means of a rope connecting the boat to ring 16 attached to front holding stake 18. Front holding stake 18 pierces through telescoping tongue 20 which secures the invention to the shore, and in addition, maintains the upright stability of the modified "H" shaped platform of the invention. By utilizing a telescoping tongue, the most appropriate location of the platform relative to the stake (considering the length of the boat) may be achieved. In FIG. 1, tongue 20 operably connects to the center horizontal piece 22 of the platform which in turn has attached at its ends, oppositely situated and angled telescoping legs 24 and 26. Legs 24 and 26 are resting on or in bottom 28 of the lake. It may be necessary and advisable to force legs 24 and 26 into the mud in the bottom of the lake for a better secured position.

Rising centrally from center piece 22 are one of the two plates which attaches to the center horizontal piece 22, here shown the rear plate 30, to which also is attached a pair of upwardly protruding pivotal arms, the arm being shown in FIG. 1 being right arm 32. Left arm 34 is just barely visible in FIG. 1 on the other side of the boat, but is shown in full view in FIG. 2. Attached to each of the upwardly protruding arms, and specifically right arm 32 in FIG. 1 is right cradle element 36 consisting of, in the preferred embodiment, a piece of redwood lumber approximately two feet long and five inches wide. This lumber board is preferably covered with rug material which is fixed by wrapping the board and then tacking on the rear side. Left cradle member 38 (not shown) is on the opposite side of the boat operably attached to the left arm.

It is between these two cradle members that boat 12 actually rests and is the only part of the invention which may touch boat 12. As will be shown in FIG. 2, the right and left cradle members themselves are allowed a small amount of rotational freedom in the direction of their longitudinal axis by their attachment to the extensions of the right and left arm respectively. This is shown more clearly in FIG. 2. Supporting each of the upwardly protruding arms in position is structural support element 40, support element 40 being an elongated piece of metal attaching at one end to one of the upright arms and attached at the other end to center horizontal piece 22. Near one end of structural support element 40, a plurality of holes are drilled, one of which will receive a bolt which also passes through center piece 22 to fixedly adjust the pivotal position of each of the arms, to make the arms nearly vertical for a very slim boat or almost horizontal for a very wide boat. There are two structural support elements, the right support element shown in FIG. 1 by the numeral 40 and the left structural support element partially shown on the opposite side by the numeral 42.

Figure 2:
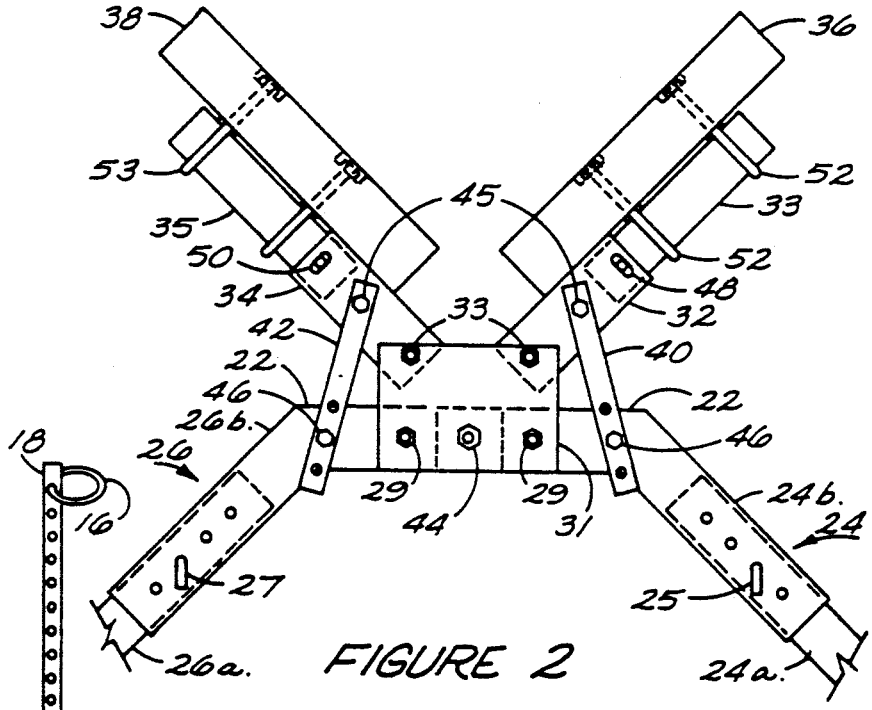
FIG. 2 is a front view of the subject inventive portable boat dock.

Referring now to FIG. 2, a front view of the subject invention without the boat and out of the water is detailed. Here, the structural elements of the invention are more clearly seen and in addition, the symmetry of the invention from side to side is also shown. More specifically, and beginning at the lower portion of the invention, right and left legs 24 and 26 respectively are shown. It is noted that the invention is viewed from the tongue side even though the tongue has been removed. Continuing, it is quickly noticed that the respective legs are telescoping type legs wherein one member slips within the other and is secured at desired lengths by pins. In the preferred embodiment, square aluminum pipe was utilized for the legs with a smaller sized square pipe allowed to enter the cavity of the larger square pipe. Lower right leg **24*a* is the interior slidable leg and 24*b* is the exterior surrounding leg. Interior leg 24*a* has a plurality of spaced apart holes situated in its upper portion which normally resides interiorly to exterior leg 24*b* and exterior leg 24*b* has a single hole drilled transversely through its sides. By the alignment of an appropriate hole in interior leg 24*a* and the single opening through exterior leg 24*b*, the two legs may be pinned together by means of leg pin 25. The same situation holds fast in the relationship of left telescoping leg 26, leg 26 comprising interior leg 26*a* and exterior leg 26*b*. These two legs, are also drilled as was their counterpart in leg 24, are pinned at an appropriate length by means of leg pin 27**.

Both left and right legs 24 and 26 respectively join to center horizontal piece 22 (and in the preferred embodiment both legs **24*b* and 26*b*, together with center piece 22, comprise a single length of metal tubing). To center piece 22 is attached two plates, here shown front plate 31, each plate on an opposite side of center piece 22**.

Both plate 30, counterpart of plate 31, and plate 31, are preferably aluminum plates having a thickness of about ¼ inch. Both plates are held to center piece 22 by means of a pair of bolts and nuts shown by the numeral 29 in FIG. 2. Centrally located to bolts 29 shown in FIG. 2 is another single bolt 44 which, as will be shown in FIG. 3, secures a square box receiver to the rear side of the platform shown in FIG. 2, the square box receiver adapted to receive tongue 20. As by now is obvious, front and rear plates 30 and 31 are held and secured parallel apart by the thickness of center piece 22.

Continuing, right and left arms 32 and 34 are shown, each attached pivotally between the front and rear plates 30 and 31 respectively by means of bolts 33. To sustain their upward position at a desired angle, right structural support element 40 is shown as is left structural support element 42. As mentioned in connection with FIG. 1, these structural support elements attach at one end to their particular arm and at the other end adjustably to center piece 22. The plurality of openings in the lower portion of each of the structural support elements 40 and 42 are shown in FIG. 2. Obviously, both right and left structural support elements are allowed some small amount of rotational freedom about the top securing bolts 45. Lower bolts 46 secure the lower portion of the structural support elements 40 and 42 to center piece 22.

In the preferred embodiment, round aluminum pipe was utilized for left and right arms 32 and 34 respectively. Obviously, the outside diameter of these round pipes was the same as the width of square pipe which comprises center piece 22. Situated interiorly to right and left arms 32 and 34 respectively is a second round pipe, namely right extension arm 33 and left extension arm 35. To allow a small amount of rotational freedom of each extension arm within the primary arm, elongated slot 48 was cut into the wall of right arm 32 and elongated slot 50 cut into the wall of left arm 34. Residing interiorly to each of these slots is a bolt which passes completely through each of the left and right arms and through a single opening in the right and left extension arms. This bolt, numerated 51, is better shown in FIG. 3, and in FIG. 2 resides in elongated slot 48 on the right arm 34. Similarly, a bolt resides with slot 50 of left arm 34. By this means, limited rotation of right and left extension arms 33 and 35 is permitted.

Permanently attached to each of the right and left extension arms are the right and left cradle members 36 and 38 respectively. These members, which in the preferred embodiment comprise redwood lumber, attach to each the right and left extension arms 33 and 35 by means of "U" bolts 52 encompassing arm 33 and then passing through right cradle member 36 and "U" bolts 53 for accomplishing the same for left cradle member 38. The ends of these "U" bolts penetrate the cradle members and are attached on the other side with a countersunk washer and nuts.

Thus as can be seen from FIG. 2, many variables are constructed into the invention for increased utility, firstly by extending or shortening the lengths of each of the telescoping legs, the legs held in the chosen secured length by leg pins, to accommodate various depths of water or lake bottoms. Then, the angle between each of the cradle members may be adjusted to accommodate a relatively narrow boat or relatively wide boat by means of the pivotal action of the left and right arms 32 and 34 relative to center plates 30 and 31. The position of the arms, once determined and set, is then fixedly secured by means of the right and left structural support elements 40 and 42. To better accommodate the sides of the boat, especially in a flat side to side manner, the carpet covered right and left cradle members 36 and 38 are rotational about their longitudinal direction by means of slots 48 and 50 formed in the right and left arms and the bolts running interiorly to the slots, these bolts also passing through the right and left extension arms. Lastly, as mentioned in connection with FIG. 1, telescoping tongue 20 may be lengthened or shortened to vary the distance between the modified "H" shaped platform and the front stake to accommodate boats of various lengths and/or different lake shore or near shore lake bottoms, i.e., how fast the bottom falls off from the shore. As is obvious, most any size craft may be easily docked with the invention.

Figure 3:
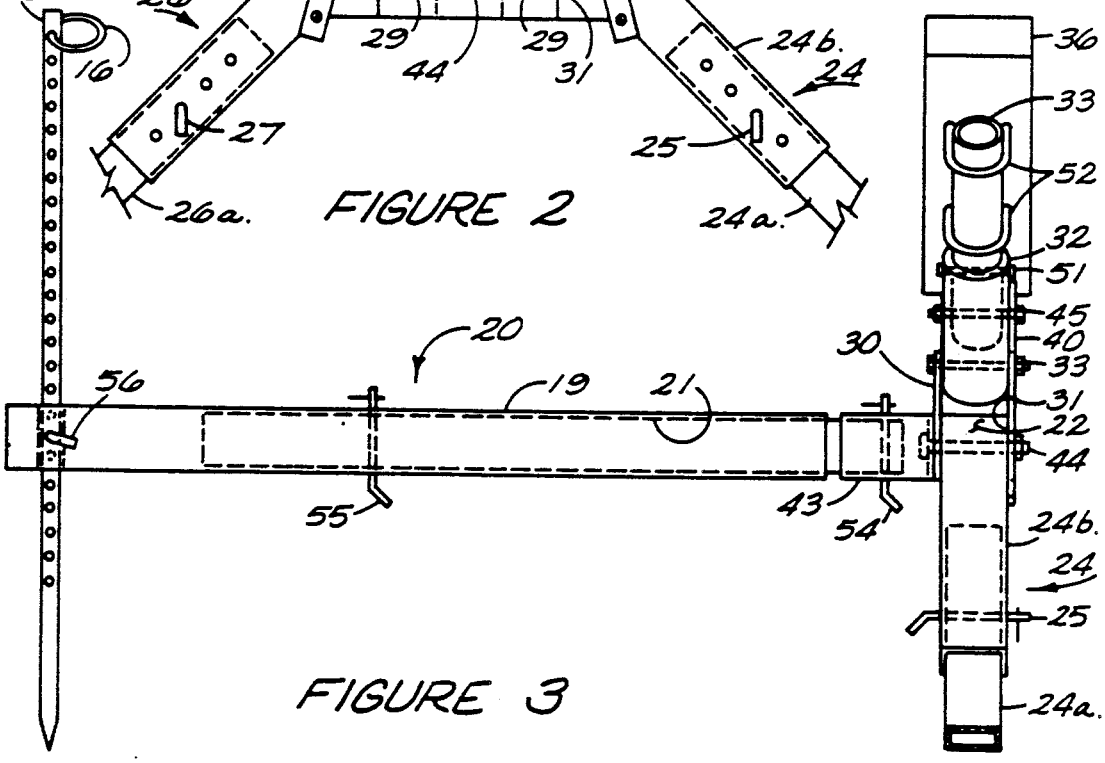
FIG. 3 is a side view of the subject inventive portable boat dock.

Finally, referring to FIG. 3, a side view of the subject invention is disclosed showing in more detail the view broadly disclosed in FIG. 1.

In FIG. 3, starting at the right-hand side, the modified "H" shaped platform is seen, here the right side. Starting at the top, carpet covered right cradle member 36 is in turn attached to right extension arm 33 by means of surrounding "U" bolts 52. Securing right extension arm 33 to right arm 32 and providing the limited rotational ability of right extension arm in right arm 32 is bolt 51 passing through both the right extension arm 33 and right arm 32. Pivotally attaching right arm 32 to the front and rear plates 31 and 30 respectively is bolt 33. Immediately above bolt 33 is bolt 45, bolt 45 attaching the top end of right structural support element 40 to right arm 32. The lower end of right structural support element 40 attaches to center piece 22 by bolt 46 which, in this view, has been eliminated in order that square box receiver bolt 44 may be displayed. Bolt 46 would be immediately in front of and covering the view of square box receiver bolt 44. Continuing down, square box receiver 43 is shown attaching to rear plate 30 by means of square box receiver bolt 44. Square box receiver 43, as its name suggests, is square in shape and receives the tongue of the invention. Square box receiver 43 obviously has a bottom plate welded to it so it takes on the appearance of a cap, this bottom plate having an opening through it adapted to receive bolt 44. Continuing on down with the platform before entering into the construction of tongue 20, telescoping leg 24 is shown comprising exterior leg **24*b* and inside interior leg 24*a*. The interior leg is held relative to the exterior leg by means of leg pin 25. As seen in FIG. 3, leg pin 25** is merely a short piece of round metal rod, bent over at one end, and has a hole drilled transversely through the other end which receives a cotter pin.

Now, pursuing the construction of tongue 20 and beginning at the modified "H" shaped platform, square box receiver 43 is attached to the platform at the level of center piece 22 and to both the rear and front plates 30 and 31 respectively by means of bolt 44. Residing interiorly to tongue 20, and providing the telescoping ability of tongue 20 is inner tongue 21, inner tongue 21 surrounded by outer tongue 19. Inner tongue 21 is secured in square box receiver 43 by means of forward tongue pin 54, tongue pin 54 passing through holes drilled through the sides of square box receiver 43 and inner tongue 21. Continuing, inner tongue 21 has a plurality of transverse holes drilled through it which allow its positional securing by means of at least one hole drilled through outer tongue member 19, rear tongue pin 55 then passing through the holes in both the members when they are aligned to the chosen length.

Lastly, attached to the distal end of tongue 20 is front holding stake 18. Stake 18 is sharpened at one end, the sharpened lower end adapted to penetrate the shore ground and the top end having ring 16 to which a rope attaches from the bow of the boat. Finally securing front stake 18 to outer tongue element 19 is stake pin 56, the pin passing through a hole in outer tongue element 19 and one of the many plurality of holes in stake 18. By the shown means, the height of tongue 20 above ground or below water may be adjusted at the shoreline.

As earlier mentioned, the length of the tongue may be adjusted to place the platform in best position relative to the shoreline and the depth of the water at the place where the platform rests upon the bottom of the lake. In addition, for various length boats, position of the platform relative to the front stake may be indeed important.

As mentioned earlier in connection with various parts of the invention, aluminum is the preferred metal of construction of all parts because of its ability to resist rust and its light weight. Steel, of course, may be used. 1½ inch square tubing was utilized for center piece 22 exterior legs **24*b* and 26*b*, and outer tongue 19. 1½ inch round tubing was used for legs 32 and 34**. The square and round tubing which resided interiorly to the above cited tubing were appropriate sized to achieve a slidable fit, but not a tight fit which might hang up when sliding. Where nuts and bolts are utilized, stainless steel bolts are suggested and ny-lock nuts utilized. Pins may be made out of aluminum or stainless steel.

While a preferred embodiment of the invention has been shown and described, it will be appreciated that there is no intent to limit the invention by such disclosure. Rather, the disclosure is intended to cover all modifications and alternate embodiments falling within the spirit and the scope of the invention as defined in the appended claims.

We claim:

1. A portable boat dock for receiving and securing opposite sides of a boat in a body of water having a shoreline and a bottom, said portable boat dock comprising:

a platform adapted to reside substantially under water, said platform including a central horizontal member, a pair of legs attached to said central horizontal member, a pair of plates also attached to said central horizontal member, and a pair of upwardly protruding arms operably attached to said pair of plates, said pair of legs adapted to reside on the bottom of the body of water and said upwardly protruding arms adapted to reside on opposite sides of the boat being secured;

a tongue attached to said platform to secure said platform in an upright position; and a front holding stake adapted to be secured proximate the shoreline, said stake operably connected to said tongue whereby said platform is secured upright proximate the shoreline.

2. The portable boat dock as defined in claim 1 wherein said tongue defines an elongated tongue of two ends, one end of which operably attached to said platform and the other end of which operably attached to said front holding stake.

3. The portable boat dock as defined in claim 2 wherein said pair of legs defines a pair of spaced apart angled legs.

4. The portable boat dock as defined in claim 3 wherein said pair of spaced apart angled legs defines a pair of spaced apart exterior legs and a pair of interior legs, said interior legs telescoping into said exterior legs.

5. The portable boat dock as defined in claim 4 wherein said pair of upwardly protruding arms each have an upper and a lower end, each said lower end pivotally attached to said pair of plates.

6. The portable boat dock as defined in claim 5 further including a pair of arm structural supports, each of said pair of arm structural supports having an upper and a lower end, said upper end of each of said pair of arm structural supports attached to one of each pair of upwardly protruding arms, and the lower end of each of said pair of arm structural supports operably attached to said central horizontal member whereby said each one of said pair of upwardly protruding arms, after pivoting, is held in a fixed position by one of each of said pair of arm structural supports.

7. The portable boat dock as defined in claim 6 wherein said pair of upwardly protruding arms includes a pair of arm extensions, each one of said pair of arm extensions operably attached to a corresponding one of said pair of upwardly protruding arms.

8. The portable boat dock as defined in claim 7 wherein said pair of arm extensions includes a pair of cradle members, each one of said pair of cradle members adapted to reside on either side of the boat secured.

9. The portable boat dock as defined in claim 8 wherein said pair of arm extensions is rotatably connected to said pair of upwardly protruding arms through a limited amount of rotation whereby said pair of cradle members attached to said pair of arm extensions may rotate a limited amount to accommodate the sides of the boat when the boat is secured.

10. The portable boat dock as defined in claim 8 wherein said platform, tongue and front holding stake comprise aluminum and said pair of cradle members comprises redwood.

11. The portable boat dock as defined in claim 2 wherein said elongated tongue defines a telescoping tongue, said telescoping tongue including an outer tongue and an inner tongue.

12. The portable boat dock as defined in claim 4 wherein said front holding stake comprises an elongated stake having a plurality of spaced apart holes formed transversely to said stake's elongation, said elongated tongue pinned to said stake through one of the plurality of spaced apart openings.

13. The portable boat dock as defined in claim 12 wherein said stake further includes a ring, said ring adapted to receive and secure the boat.

14. The portable boat dock as defined in claim 4 wherein said elongated tongue is attached to said platform by means of a pin.

* * * * *